US005495675A

United States Patent [19]

Huang

[11] Patent Number: 5,495,675

[45] Date of Patent: Mar. 5, 1996

[54] LASER SIGHT FOR USE IN ARCHERY

[75] Inventor: Chaochi Huang, Taipei, Taiwan

[73] Assignee: Quarton, Inc., Taipei, Taiwan

[21] Appl. No.: 411,510

[22] Filed: Mar. 28, 1995

[51] Int. Cl.[6] ..... F41G 1/36

[52] U.S. Cl. ..... 33/241; 33/265; 33/DIG. 21; 124/87

[58] Field of Search ..... 33/241, 258, 260, 33/261, 265, DIG. 21; 124/87

[56] References Cited

U.S. PATENT DOCUMENTS

| | | | |
|---|---|---|---|
| 4,961,265 | 10/1990 | Roberts | 33/265 |
| 5,228,204 | 7/1993 | Khoshnood | 33/265 |
| 5,414,936 | 5/1995 | Sappington | 33/265 |
| 5,419,050 | 5/1995 | Moore | 33/241 |

*Primary Examiner*—Christopher W. Fulton
*Attorney, Agent, or Firm*—Bacon & Thomas

[57] ABSTRACT

A laser sight including a mounting base fixed to the bow back of a bow, a first holder frame fastened to the mounting base and adjusted in the X-axis direction, a second holder frame fastened to the first holder frame and adjusted in the Y-axis direction, a third holder frame fastened to the second holder frame and adjusted in the Z-axis direction and having a sight blade, and a laser module fastened to a swivel laser module holder on the third holder frame, wherein the swivel laser module holder is fastened to the third holder frame by an adjustment screw and can be turned about the adjustment screw to adjust the angle of inclination of the laser module for allowing the laser beam from the laser module to be aimed at a target when the sight blade is aligned with the target.

3 Claims, 5 Drawing Sheets

LASER SIGHT FOR USE IN ARCHERY

BACKGROUND OF THE INVENTION

The present invention relates to laser sights, and relates more particularly to such a laser sight that can be conveniently fixed to a bow and used to guide the eye at night.

Various sights have been developed for use in archery. However, conventional sights have numerous drawbacks. These conventional sights are commonly huge and add a big weight to the bow. Another drawback of these conventional sights is that they are difficult to be adjusted. Still another drawback of these conventional sights is that they are complicated and difficult to be installed in the bow. Still another drawback of these conventional sights is that they are not suitable for use at night or during the dark. Still another drawback of these conventional sights is their limited effective range. A yet further disadvantage of these conventional sights is their short service life.

SUMMARY OF THE INVENTION

The present invention has been accomplished to provide a laser sight specifically designed for use in archery which eliminates the aforesaid drawbacks. It is therefore an object of the present invention to provide a laser sight which is suitable for use at night and during the dark. It is another object of the present invention to provide a laser sight which can be conveniently adjusted to guide the eye to any of a variety of targets at any of a variety of distances. It is still another object of the present invention to provide a laser sight which can be conveniently fixed to the bow. It is still another object of the present invention to provide a laser sight which is easy to assembled. It is yet a further object of the present invention to provide a laser sight which is simple and lightweight.

According to the preferred embodiment of the present invention, the laser sight comprises a mounting base fixed to the bow back of a bow, a first holder frame fastened to the mounting base and adjusted in the X-axis direction, a second holder frame fastened to the first holder frame and adjusted in the Y-axis direction, a third holder frame fastened to the second holder frame and adjusted in the Z-axis direction and having a sight blade, and a laser module fastened to a swivel laser module holder on the third holder frame, wherein the swivel laser module holder is fastened to the third holder frame by an adjustment screw and can be turned about the adjustment screw to adjust the angle of inclination of the laser module for allowing the laser beam from the laser module to be aimed at a target when the sight blade is aligned with the target. Further more, the swivel laser module holder has graduations matching with an index on the third holder frame for reference in adjusting the angle of inclination of the laser module.

DETAILED DESCRIPTION OF THE PREFERRED EMBODIMENT

Figure 1:
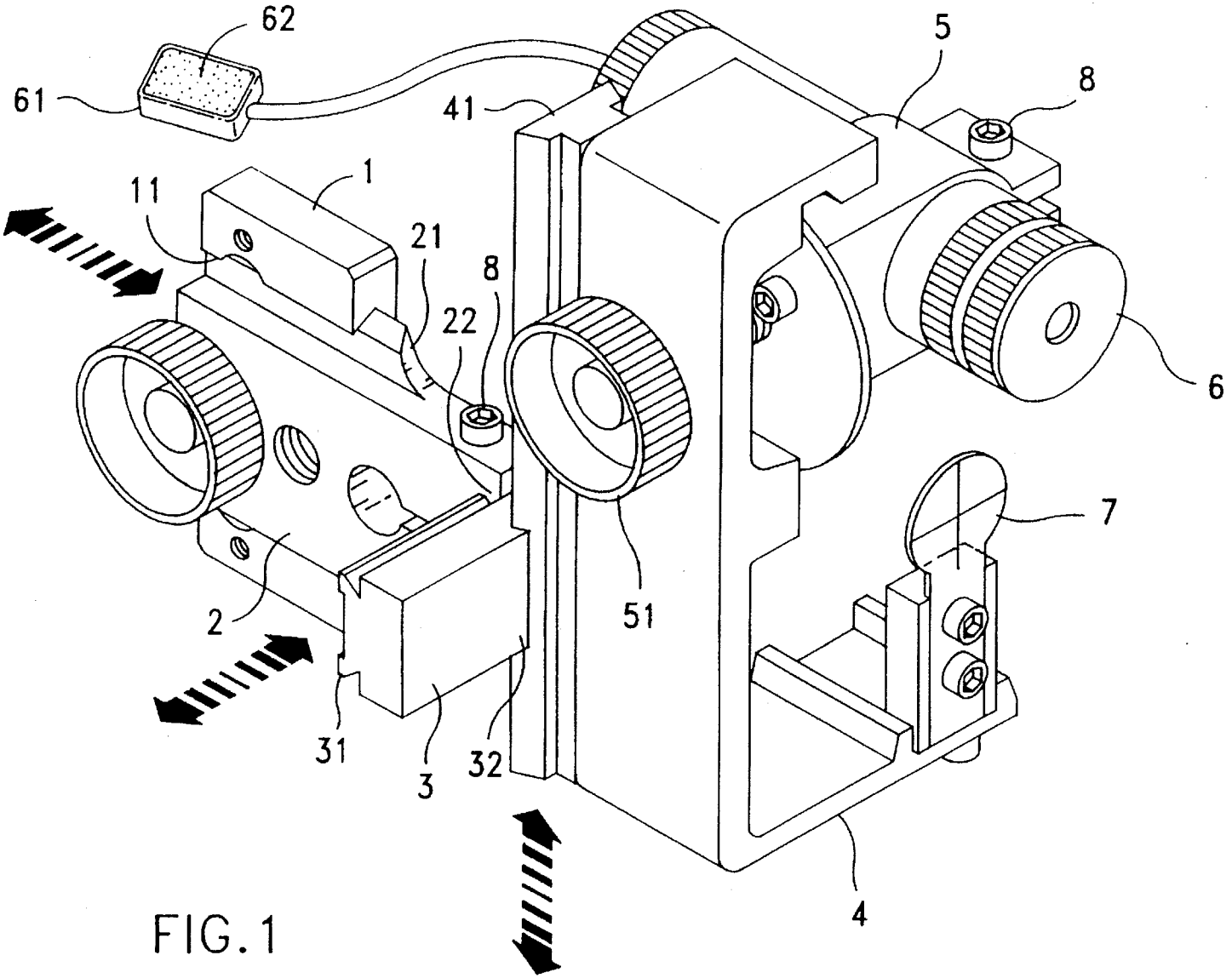
FIG. 1 is an elevational view of a laser sight according to the present invention.
Figure 2:
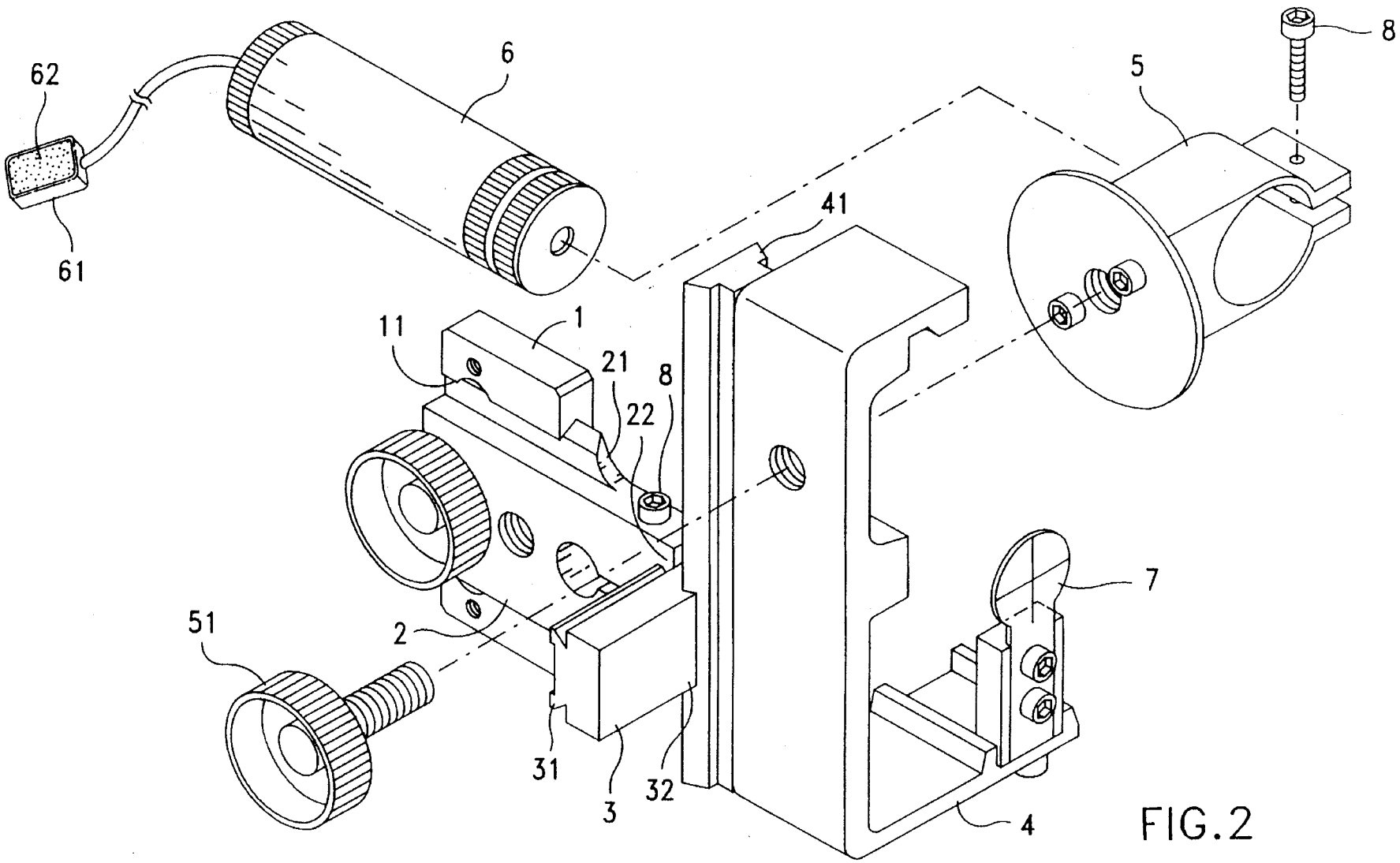
FIG. 2 is an exploded view of the laser sight shown in FIG. 1.

Referring to FIGS. 1 and 2, a laser sight in accordance with the present invention is generally comprised of a mounting base 1, an X-axis holder frame 2, a Y-axis holder frame 3, a Z-axis holder frame 4, a swivel laser module holder 5, and a semiconductor laser module 6.

Figure 2A:
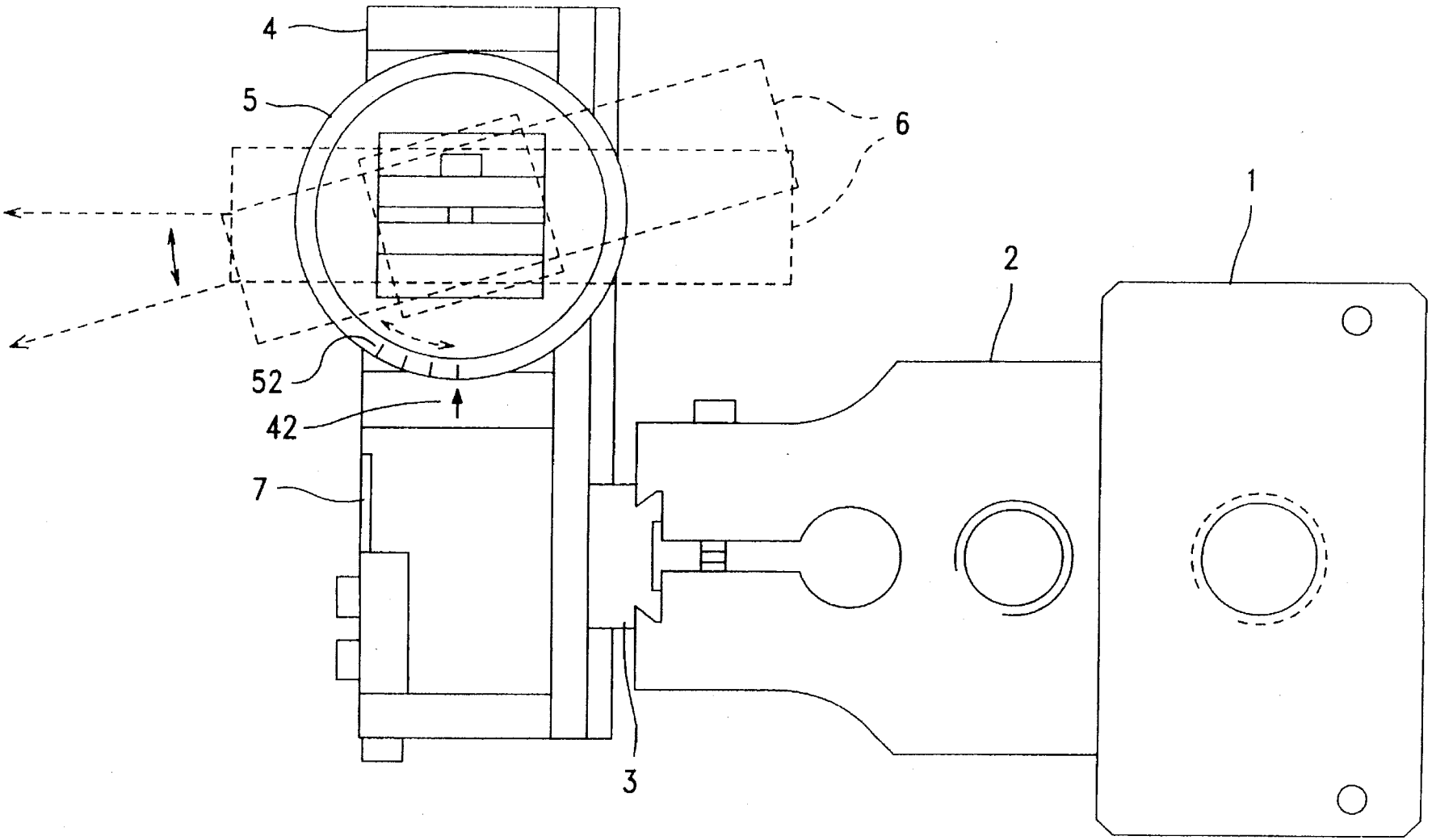
FIG. 2A is a side plain view of the laser sight shown in FIG. 1.

Referring to FIG. 2A and FIGS. 1 and 2 again, the mounting base 1 has a dovetail groove 11 transversely disposed at one side thereof in the middle. The X-axis holder frame 2 has a dovetail tongue 21 longitudinally disposed at a top side thereof engaged with the dovetail groove 11 on the mounting base 1, and a dovetail groove 22 transversely disposed at a front side thereof. The Y-axis holder frame 3 has a dovetail tongue 31 longitudinally disposed at one side thereof and engaged with the dovetail groove 22 on the X-axis holder frame 2, and a dovetail groove 32 transversely disposed at an opposite side thereof in the middle. The Z-axis holder frame 4 has a dovetail tongue 41 longitudinally disposed at one side thereof and engaged with the dovetail groove 32 on the Y-axis holder frame 3. The swivel laser module holder 5 is fastened to the Z-axis holder frame 4 by a screw 51 to hold the laser module 6. When the laser module 6 is mounted on the swivel laser module holder 5, the swivel laser module holder 5 is fixed by a screw 8 into the closed position to hold down the laser module 6. When the laser module 6 is installed, its angle of inclination can be adjusted by turning the swivel laser module holder 5 about the adjustment screw 51. The Z-axis holder frame further comprises a sight blade 7 disposed right below the swivel laser module holder 5, and an index 42 adjacent to the swivel laser module holder 5. The swivel laser module holder 5 has graduations 52 matching with the index 42 for reference in adjusting the angle of inclination of the laser module 6 (see FIG. 2A). The laser module 6 has a touch control switch 61 fixed with an adhesive tape 62. By means of the adhesive tape 62, the touch control switch 61 can be fixed to the bow when the laser sight is installed.

Figure 3:
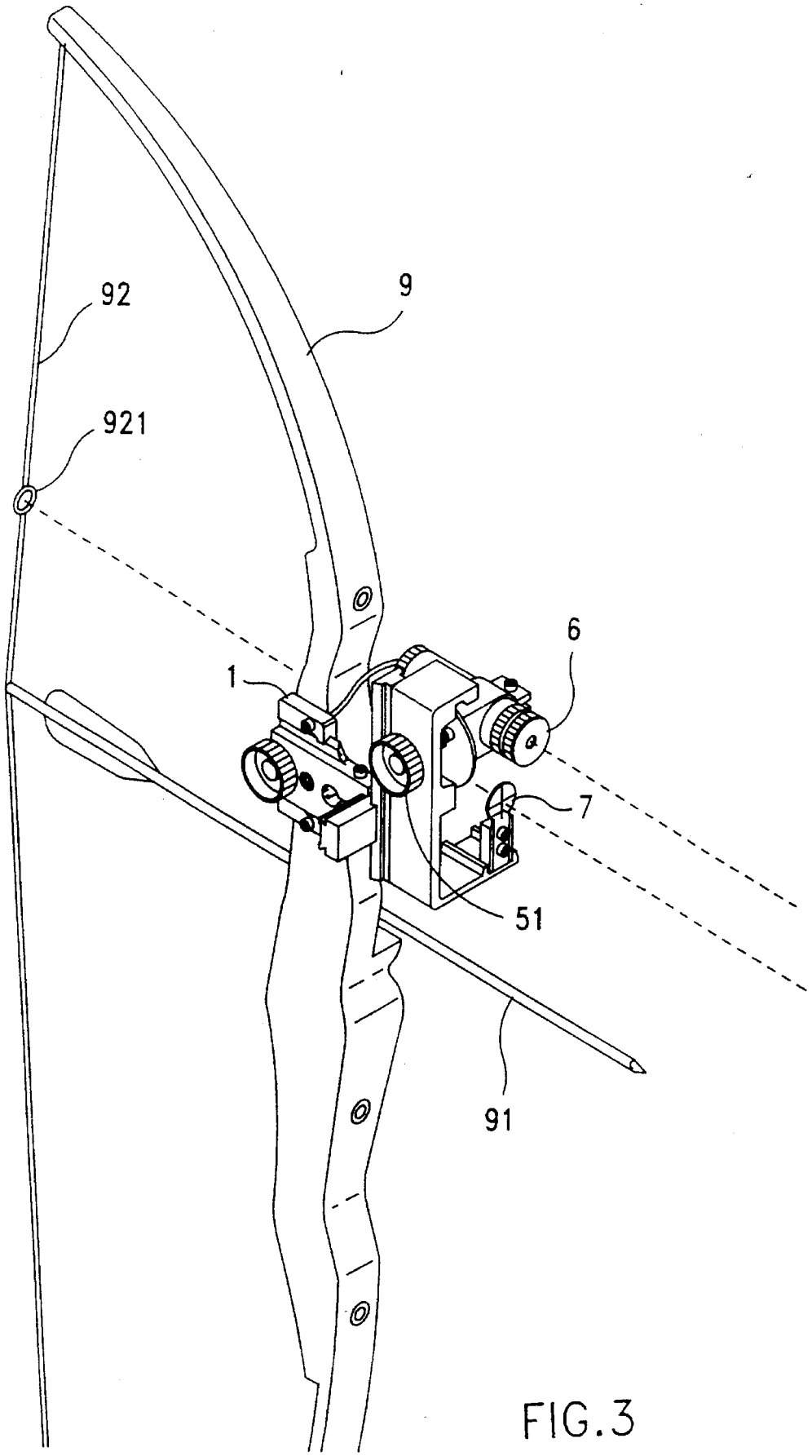
FIG. 3 is an installed view showing the laser sight of FIG. 1 fixed to a bow.
Figure 4:
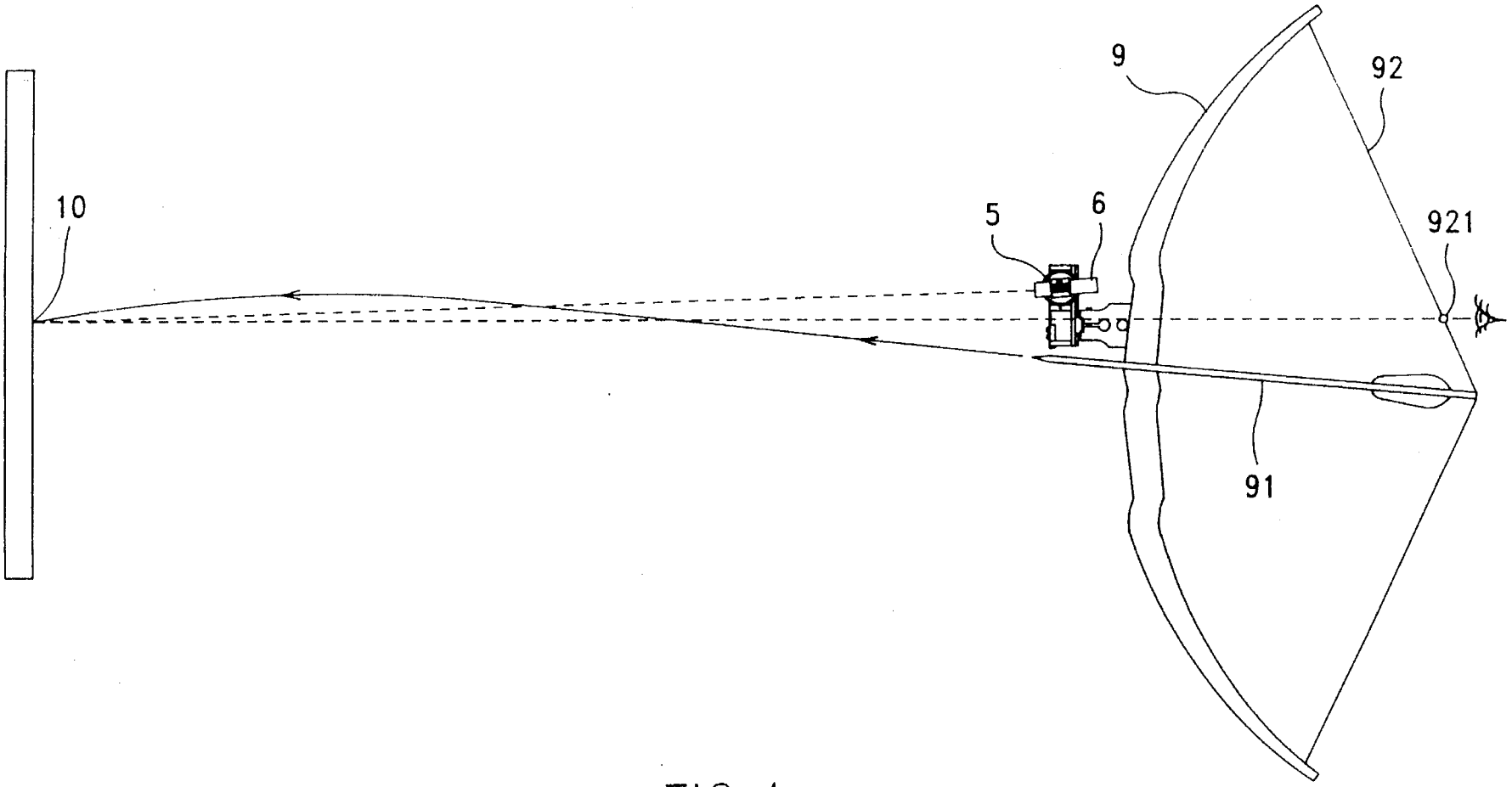
FIG. 4 shows the laser sight of FIG. 3 operated to guide the eye to the target.

Referring to FIGS. 3 and 4, when the mounting base 1 is fixed to the bow back 9, the view hole 921 on the bowstring 92 and the sight blade 7 must be aligned with the the center point of the target 10. When aligned, the swivel laser module holder 5 is turned about the adjustment screw 51 to change the angle of inclination of the laser module 6 so as to ensure that the laser beam of the laser module 6 hits the center point of the target 10. When the adjustment is done, the arrow 91 can be then shot from the bow.

While only one embodiment of the present invention has been shown and described it will be understood that various modifications and changes could be made without departing from the spirit and scope of the invention.

What is claimed is:

1. A laser sight comprising a mounting base fixed to the bow back of a bow, a first holder frame fastened to said mounting base by a dovetail joint and adjusted in the X-axis direction, a second holder frame fastened to said first holder frame by a dovetail joint and adjusted in the Y-axis direction, a third holder frame fastened to said second holder frame by a dovetail joint and adjusted in the Z-axis direction, and a laser module fastened to said third holder frame, wherein said third holder frame comprises a swivel laser module holder fixed in place by an adjustment screw to hold said laser module in place, and a sight blade disposed below said swivel laser module holder, said laser module holder being turned about said adjustment screw to adjust the angle of inclination of said laser module for allowing the laser beam from said laser module to be aimed at a target when said sight blade is aligned with said target.

2. The laser sight of claim 1 wherein said laser module has a touch control switch through which said laser module is triggered to emit a laser beam.

3. The laser sight of claim 2 wherein said touch control switch is fixed with an adhesive means for fastening to the bow.

* * * * *